United States Patent [19]

Kobayashi et al.

[11] 4,106,409

[45] Aug. 15, 1978

[54] ELECTROSTATIC PRINTING METHOD

[75] Inventors: Hajime Kobayashi, Mitaka; Yasuhiro Yano, Tokyo; Ichiro Endo, Yokohama, all of Japan

[73] Assignee: Canon Kabushiki Kaisha, Tokyo, Japan

[21] Appl. No.: 761,401

[22] Filed: Jan. 21, 1977

[30] Foreign Application Priority Data

Jan. 26, 1976 [JP] Japan ..... 51-7740

[51] Int. Cl.[2] ..... G03G 13/14; G03G 15/00; G03G 5/04

[52] U.S. Cl. ..... 101/426; 101/DIG. 13; 96/1.3; 96/1.4; 96/1.5 R; 346/153; 355/3 CH; 355/3 TR

[58] Field of Search ..... 101/1, DIG. 13, 131, 101/426, 465, 467; 96/1 R, 1.4, 1.5 R, 66 R, 1.3; 204/15; 427/20, 19; 346/150, 153; 355/3 R, 3 CH, 3 TE, 3 TR

[56] References Cited

U.S. PATENT DOCUMENTS

| | | | |
|---|---|---|---|
| 2,756,676 | 7/1956 | Steinhilper | 96/1 R |
| 2,924,519 | 2/1960 | Bertelsen | 96/1 R |
| 3,033,765 | 5/1962 | King et al. | 96/1.5 X |
| 3,132,963 | 5/1964 | Jarvis | 101/DIG. 13 |
| 3,161,529 | 12/1964 | Curme | 101/DIG. 13 |
| 3,368,894 | 2/1968 | Matkan et al. | 101/131 X |
| 3,457,075 | 7/1969 | Morgan et al. | 96/67 |
| 3,957,493 | 5/1976 | Masuda et al. | 96/114.1 |
| 4,009,039 | 2/1977 | Masuda et al. | 96/114.1 |

*Primary Examiner*—E.H. Eickholt

*Attorney, Agent, or Firm*—Fitzpatrick, Cella, Harper & Scinto

[57] ABSTRACT

In an electrostatic printing process utilizing a printing master formed by exposing and heat developing a photosensitive element formed from a reducible organic silver salt, image forming capability is enhanced by a preheating of the image-forming member prior to said exposure and heat developing of the exposed image.

9 Claims, 8 Drawing Figures

ELECTROSTATIC PRINTING METHOD

This application contains subject matter related to commonly assigned application Ser. No. 599,061 filed July 25, 1975, now U.S. Pat. No. 4,069,759 issued Jan. 24, 1978; Ser. No. 685,460 filed May 12, 1976, now U.S. Pat. No. 4,057,016; Ser. No. 608,006 filed Aug. 26, 1976, now U.S. Pat. No. 4,036,650; Ser. No. 761,368 filed Jan. 21, 1977; Ser. No. 761,069 filed Jan. 21, 1977; Ser. No. 763,087 filed Jan. 27, 1977 and Ser. No. 827,779 filed Aug. 25, 1977.

BACKGROUND OF THE INVENTION

1. Field of the Invention

This invention relates to a process for electrostatic printing and more particularly, it relates to a process for electrostatic printing by using a master of high sensitivity, high durability, and panchromatic response.

2. Description of the Prior Art

Many printing methods are known. Among them, electrostatic printing methods belong to a special class. The principle of ordinary printing is based on selective application of ink onto the surface of a printing master due to uneven surface condition of the printing master or difference in solvent affinity, and transfer of the ink to a paper by a pressing action. On the other hand, in the electrostatic printing, the ink is replaced by a heat-fixable toner which is electrostatically adhered to a printing master, then transferred to and fixed on an image-receiving sheet, e.g., paper. While the ordinary printing has such as advantage that the ink is placed uniformly and firmly on the printing master to enable a large number of sheets of paper to be printed at high speed, it has such as a disadvantage that the ink is liable to adhere to portions of printing paper other than those to be printed. On the other hand, in the electrostatic printing methods, the toner can be adhered electrostatically so that firmness and uniformity of adhesion are heartily known dependent upon electrostatic "contrast" which is difficult to achieve, hence the method is not suitable for high speed printing, although staining of the printing paper as mentioned above is not so much problem as in ordinary printing. In view of the stated disadvantages, electrostatic printing has not been practically used as a clean printing method. In other words, electrostatic printing is poorer than conventional printing methods as to providing uniform and clear print in large number of sheets. For example, a representative electrostatic printing master which have been known is composed of a conductive support and an insulating image overlying the conductive support, or composed of an insulating support and a conductive image overlying on the insulating support. The image may be produced by applying an insulating or a conductive lacquer in the form of an image pattern onto the support, or by coating a photosensitive lacquer on a support, imagewise exposing and selectively removing the exposed or unexposed portions by etching. Such electrostatic printing masters have various drawbacks. For example, when it is used in the conventional electrostatic printing process sharpness of the printed image and durability of the master are usually poor. Such electrostatic printing process includes a charging step for forming an electrostatic image by selectively retaining electric charge at image portions, (the image portions are insulating), a developing step, in which a toner having a polarity opposite to that of the image portions is applied, and a transfer step, in which the toner image is transferred to a receiving sheet. For example, the known electrostatic printing master has images formed on its uneven surface, and such uneven surface is damaged by mechanical abrasion during the printing process to cause irregular charging, so that durability of the master is very low. Further more, it is very difficult to obtain a high resolving power with such uneven surface type master and also technically difficult to obtain a print having high resolution. Additionally, it is difficult to obtain images of half tone or gradation with such uneven surface type master.

SUMMARY OF THE INVENTION

In order to solve the disadvantages inherent in the conventional electrostatic printing master as mentioned in the foregoing, it is an object of the present invention to provide an improved electrostatic printing method, wherein an electrostatic printing master is used.

It is another object of the present invention to provide and electrostatic printing method of high sensitivity and panchromatism.

According to the present invention, there is provided a process for electrostatic printing which includes (1) a step for forming an electrostatic latent image by subjecting a printing master to an electric charging treatment, (2) a step of developing the electrostatic latent image, and (3) a step of transferring the developed image onto an image-receiving material, and the improvement comprises: employing an electrostatic printing master formed by (A) subjecting an image-forming member to a preheat treatment to enhance image-forming capability, said member having a first layer, wherein an organic silver salt is dispersed in an electrically insulating medium and a reducing agent is associated with said first layer, (B) irradiating said image-forming member with an active radiation ray, and (C) heat-developing said image-forming member.

DESCRIPTION OF THE PREFERRED EMBODIMENTS

The desirable characteristics of the electrostatic printing master used for electrostatic printing of the present invention are attributable to the fact that the silver image to form a required image is carried in an electrically insulating medium and high resolution and continuous gradation of the silver image itself. In the present invention, as the silver image is carried in the electrically insulating medium, the image of the master is not formed by unevenness of the master surface, hence the image is hardly damaged by mechanical abrasion and the master maintains excellent durability. The silver image is made of an assembly of fine metallic silver grains and the resolving power is at the fine grain level so that the resolution is very excellent. Further, when silver images are employed, the density can be changed according to optional continuous gradation by the concentration of fine grains of metallic silver, and image of continuous gradation can be easily regenerated.

Since the electrostatic printing master for use in the present invention can be prepared by developing an exposed image through a heat-treatment to form a required silver image, the electrostatic printing method can be practiced with continuity and instantaneity starting from preparation of the electrostatic printing master to the electrostatic printing process. Particularly, the present invention, has its remarkable feature in that an image-forming capability is imparted to an image-forming member having no image-forming capability at the initial stage, or such image-forming capability is increased in the image-forming member having such image-forming capability, by subjecting the same to a pre-heating treatment either prior to an image-exposure to the image forming member, or at the time of the image-exposure, on account of which a required time for the preparation process of the electrostatic printing master by steps of the image-exposure and development under heat can be shortened, and continuous and instantaneous operations from the electrostatic printing master preparing process to the electrostatic printing process can be more effectively realized.

Figure 1:
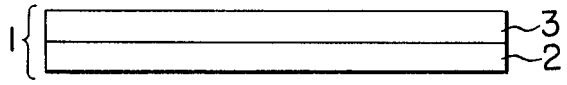
FIG. 1 shows an embodiment of an image-forming member used for the electrostatic printing according to the present invention.

Referring now to FIG. 1 which shows the most representative construction of the image-forming member for the electrostatic printing master to be used in the present invention, the image-forming member 1 consists of a layer of organic silver salt 3 and a substrate 2. The organic silver salt layer 3 is, in an ordinary case, composed principally of an organic silver salt, an electrically insulating medium, and a reducing agent. The organic silver salt is the important compound which contributes to supply of metallic silver to form a silver image of the electrostatic printing master, while the reducing agent is a compound which functions to reduce the organic silver salt at the time of the development by heating for the preparation of the electrostatic printing master so as to isolate metallic silver from the organic silver salt. The electrically insulating medium is a dispersion medium which is selected from various electrically insulating binders, possesses a film-forming capability to form an organic silver salt layer, and causes the organic silver salt, etc. to be uniformly dispersed in the organic silver salt layer. The medium is used for obtaining an electrostatic charge sustaining capability at a non-silver image portion of the electrostatic printing master so that an electrostatic latent image having an electrostatic contrast of practical quality may be formed on the master, in case the electric charging treatment is done on the electrostatic printing master having the silver image.

The image-forming member is usually obtained by the following two ways: (1) the organic silver salt and reducing agent in the abovementioned components are uniformly mixed and dispersed in the binder as the electrically insulating medium, and then the mixture is applied onto an appropriate substrate to form the organic silver salt layer; or (2) the reducing agent is mixed with a resin binder such as cellulose acetate, etc. having a film-forming capability by the use of an appropriate solvent, without causing it to be contained in the organic silver salt layer, and the mixture is applied onto the organic silver salt layer surface to form a separate reducing agent layer.

In case the reducing agent layer is formed on the organic silver salt layer, when the electric charging treatment is to be done on the master, thickness of the reducing agent layer is made sufficiently thin to avoid difficulty in forming the electrostatic latent image due to uniform charging on the surface of the reducing agent layer because of large electrostatic charge sustaining capability of the reducing agent layer. Otherwise, the binder material having the film-forming capability to be used for preparing the reducing agent layer is selected from those having no electrostatic charge sustaining capability at all, or very few of such capability. It is also possible that the reducing agent be contained in the organic silver salt layer, and be further applied on the organic silver salt layer in a manner as mentioned in the foregoing.

For the organic silver salt which can be used preferably for the purpose of the present invention, there may be enumerated the following: silver salts of organic acids, mercapto compounds and imino compounds and organic silver complex salts, of which silver salts of organic acids, particularly, silver salts of fatty acids are most effective.

Representative compounds of the organic silver salts are actually as follows.

I. SILVER SALT OF ORGANIC ACID

1. Silver salt of fatty acid (1) Silver salt of saturated aliphatic carboxylic acid For example, silver acetate, silver propionate, silver butyrate, silver valerate, silver caproate, silver enanthate, silver caprylate, silver pelargonate, silver caprate, silver undecylate, silver laurate, silver tridecylate, silver myristate, silver pentadecylate, silver palmitate, silver heptadecylate, silver stearate, silver nonadecylate, silver arachidate, silver behenate, silver lignocerate, silver cerotate silver heptacosanate, silver montanate, silver melissinate, and silver laccerate.

(2) Silver salt of unsaturated aliphatic carboxylic acid For example, silver acrylate, silver crotonate, silver 3-hexenate, silver 2-octenate, silver oleate, silver 4-tetradecenate, silver stearolate, silver docosenate, silver behenolate, silver 9-undecynate, and silver arachidonate.

(3) Silver salt of aliphatic dicarboxylic acid For example, silver oxalate.

(4) Silver salt of oxycarboxylic acid For example, silver hydroxy-stearate.

2. Silver salt of aromatic carboxylic acid (1) Silver salt of aromatic carboxylic acid For example, silver benzoate, silver 0-aminobenzoate, silver p-nitrobenzoate, silver phenylbenzoate, silver acetamidobenzoate, silver salicylate, silver picolinate, and silver 4-n-octadecyloxydiphenyl-4-carboxylate.

(2) Silver salt of aromatic dicarboxylic acid For example, silver phthalate, and silver quinolinate.

3. Silver salt of thiocarboxylic acid

For example, silver $\alpha,\alpha'$-dithiodipropionate, silver $\beta,\beta'$-dithiodipropionate and silver thiobenzoate.

4. Silver salt of sulfonic acid

For example, silver p-toluenesulfonate, silver dodecylbenzenesulfonate and silver taurinate.

5. Silver salt of sulfinic acid

For example, silver p-acetaminobenzenesulfinate.

6. Silver salt of carbamic acid

For example, silver diethyldithiocarbamate.

II. Silver salt of mercapto compound

For example, silver 2-mercaptobenzoxazole, silver 2-mercaptobenzothiazole and silver 2-mercaptobenzimidazole.

III. Silver salt of imino compound.

For example, silver 1, 2, 4-triazole, silver benzimidazole, silver benztriazole, silver 5-nitrobenzimidazole, silver 5-nitrobenztriazole and silver 0-sulfobenzimide.

IV. Organic silver complex salt

For example, silver di-8-hydroxyquinoline and silver phthalazone.

The reducing agent is used to visualize a latent image formed by the exposure. The reducing agent effectively used includes phenols, bisphenols, naphthols, di or polyhydroxybenzenes and the like. As the examples of the reducing agent, there may be mentioned the following.

(1) Phenols

For example, aminophenol, 2,6-di-t-butyl-p-cresol and p-methylaminophenol sulfate(metol).

(2) Bisphenols

For example, 2,2'-methylene bis(6-t-butyl-4-methylphenol), 4,4'-butylidene bis(6-t-butyl-3-methylphenol), 4,4'-bi(6-t-butyl-3-methylphenol), 4,4'-thio bis (6-t-butyl-2-methylphenol) and 2,2'-methylene bis (6-t-butyl-4-ethylphenol).

(3) Naphthols

For example, 2,2'-dihydroxy-1,1'-binaphthyl, 6,6'-dibromo-2,2'-dihydroxy-1,1'-binaphthyl, bis(2-hydroxy-1-naphthyl) methane and methylhydroxy-naphthalene.

(4) Di or polyhydroxybenzenes

For example, hydroquinone, methylhydroquinone, chlorohydro-quinone, bromohydroquinone, pyrogallol and catechol.

(5) Others 1-phenyl-3-pyrazolidone(phenidone).

If necessary, these reducing agents may be appropriately mixed for use. The amount of the reducing agent may be appropriately determined in accordance with the properties of the desired image-forming member. The amount thereof may be generally 5 moles or below, preperably 1 mole or below, more preperably 1 mole – $10^{-5}$ mole, per 1 mole of the organic silver salt.

The organic silver salt layer is principally composed of organic silver salt and electrically insulating medium. The reducing agent may either be contained in the organic silver salt layer, or be laminated separately over the organic silver salt layer as the reducing agent layer. The reducing agent layer may be formed singly of the reducing agent per se, or it may be mixed with a binding medium having a film-forming capability. The reducing agent layer may be inseparably laminated on the organic silver salt layer therefrom, but it may also be laminated in such a manner that it is placed on the organic silver salt layer at the time of, or prior to, the development by heating, after which it is removed, if necessary.

Since the above-enumerated organic silver salts are almost stable against light, for a desired silver image to be formed on the image forming member through the steps of image-exposure and development by heating, the above-mentioned image-forming member needs be subjected to an appropriate pre-treatment, or be added with an additive in advance besides the pre-treatment. By so doing, the image-forming member is given a required image-forming capability, or increases its image-forming capability.

For the pre-treatment, there is adopted a heat-treatment which may be done either prior to the image-exposure or simultaneously therewith. The pre-treatment by heating is usually made one of the steps for preparing the electrostatic printing master from the image-forming member. A preferred temperature range and a preferred heating time for the pretreatment by heating depend upon the kinds of the organic silver salt, reducing agent, and electrically insulating medium. In general, the heating at 50° to 150° C for a short period of time is considered desirable. While the heating time depends on the kinds of the component material for the image-forming member, it is also governed by the requirement for shorter processing time for the preparation of the electrostatic printing process. Usually, it is set at an instant of 0.1 to 30 seconds, or more specifically, shorter than 10 seconds.

For the additives, the following halides are enumerated as representative.

(1) Inorganic halide

The inorganic halide is preferably that having the general formula: MXm wherein X represents a halogen (for example, Cl, Br, I), M represents hydrogen, ammonium or a metal (for example, potassium, sodium, lithium, calcium, strontium, cadmium, chromium, rubidium, copper, nickel, magnesium, zinc, lead, platinum, palladium, bismuth, thallium, ruthenium, gallium, indium, rhodium, beryllium, cobalt, mercury, barium, silver, cesium, lanthanum, iridium, aluminum and the like), and *m* is 1 when M is hydrogen or ammonium and represents the valency of a metal when M is the metal.

In addition, silver chlorobromide, silver chlorobromoiodide, silver bromoiodide, silver chloroiodide may be also preferably used.

(2) Halogen-containing organic compound.

For example, carbon tetrachloride, chloroform, trichloroethylene, triphenylmethyl chloride, triphenylmethyl bromide, iodoform, bromoform, citylethyldimethyl ammonium bromide and the like.

When the mechanism of action of these halides has yet to be clarified, it may be assumed, as regards silver halide among those enumerated, that isolated silver is produced by exposure, and this isolated silver becomes a nucleus for the development by heating to promote isolation of silver from the organic silver salt, thereby forming the silver image. As regards the other halides than silver halide, it may be assumed that they react with the organic silver salt to produce silver halide, from which the isolated silver is produced as mentioned above, and this isolated silver becomes the nucleus for the development to form the silver image.

The above-mentioned halides may be used singly or in combination of two or more of them. The adding quantity of the halide is limited to such a range that, at the time of exposure, the nucleus for development having the minimum necessary photosensitivity may be formed, i.e., an amount which does not cause inconvenience in the development by heating.

The reason for the above-mentioned limitation to the halide quantity to be added is that, when it is added in more amount than necessary, the photosensitivity becomes higher than required owing to the presence of silver halide in the image-forming member which is photosensitive, owing to which the image-forming member is considerably sensitized even with a very slight quantity of light, e.g., when the image-forming member is unexpectedly exposed to light at the time of its storage, it immediately discolors, even if the exposure is in a very brief instant and under a very slight amount of light, to cause the so-called ground fogging; while, when it is added in less amount than necessary, the nucleus for the development cannot be formed in a quantity sufficient to accomplish the development by heating in an efficient manner.

The adding quantity of the halide which is determined on the basis of the above-mentioned reasons should usually be from 1 mol to $10^{-6}$ mol with respect to 1 mol of organic silver salt, or preferably from $10^{-1}$ mol to $10^{-6}$ mol, or optimumly from $10^{-1}$ mol to $10^{-5}$ mol.

Besides it is used in combination with organic silver in the organic silver salt layer, the halide may also be used in combination with the reducing agent by being contained in the reducing agent layer. In a particular case, the reducing agent may be contained in both organic silver salt layer and reducing agent layer. It may also be used in the form of a layer consisting of the halide per se, or containing therein a quantity of the halide, the halide layer being laminated over the organic silver layer. For example, where there is the reducing agent layer, the laminated structure of the image-forming member may be in the following combination: (1) organic silver salt layer/halide layer/reducing agent layer; (2) halide layer/organic silver salt layer/reducing agent layer; (3) reducing agent layer/organic silver salt layer/halide layer; (4) reducing agent layer/halide layer/organic silver salt layer.

As has been mentioned so far, the image-forming member prepared by adding the halide as the additive is instantaneously given the photosensitivity (image-forming capability) owing to production of silver halide through contact between the organic silver salt and the halide at the time of its preparation. Therefore, in order to secure safe storage for an extended period of time, in particular, there would arise possibility of the above-mentioned ground fogging, unless the image-forming member is tightly sealed against external light irradiation. In order to avoid such undesirable phenomenon, it becomes necessary that the addition of the halide is dispensed with, and, instead, the pre-treatment by heating to give the image-forming capability is carried out at the time of the master forming treatment, or that the organic silver salt and the halide be made coexistent in the image-forming member in a mutually isolated condition until the master forming treatment is effected.

In the image-forming member without the halide additive, since no image-forming capability is created until the pre-treatment by heating is effected, such capability being created only upon the pre-treatment, the image-forming member is stable against light, and yet it possesses a potential photosensitivity (i.e., image forming capability), hence it requires no particular treatment for storage over a long period of time.

In the image-forming member, wherein both organic silver salt and halide are coexistent in an isolated state, the reaction between them is inhibited until the master is formed. At the time of the master formation, the two compounds are sufficiently contacted each other by the pre-treatment by heating so that they interact to produce silver halide.

In order that both organic silver salt and halide may be subjected to a contact-reaction under heat at the pretreatment to produce silver halide, both compounds are separated by a thin layer of an appropriate thermoplastic resin as a reaction preventive layer which is interposed therbetween. This reaction preventive layer is caused to be present between the organic silver salt and halide until the pre-treatment by heating is effected so that the two compounds may be prevented from reaction. The thermoplastic resin to be used for this purpose is selected from polyvinyl acetal resin, e.g., polyvinyl butyral, polyvinyl formal, and, in others, cellulose acetate butyrate, all of which are particularly effective.

The reaction preventive layer formed with the above-mentioned material becomes plasticized by the action of heat, and this plasticization permits flow of both organic silver salt and halide, whereby they contact each other to react. As the result of the reaction between them, silver halide is produced, and the image-forming capability is imparted to the image-forming member.

The image-forming member having the potential image-forming capability, other than the above-mentioned, are disclosed in, for example, U.S. Pat. No. 3,764,329. The image-forming member taught in this patent contains in its organic silver salt layer a small quantity of reducible halogen compound having the essential structure of —CONX— or $SO_2NX$ (wherein X is chlorine or bromine). In this type of the image-forming member, when the pre-treatment by heating is effected prior to the image exposure and development by heating, halogen is dissociated from the reducible halogen compound to react with silver in the organic silver salt to form silver halide, and this silver halide constitutes the photosensitive nucleus at the time of the image exposure.

As the reducible halogen compound, there may be mentioned, for example, N-bromophthalimide, N-bromosuccinimide, N-bromoacetamide, N-bromoacetanilide, N-bromo-1-(2H)-phthalazinone, N,N'-dibromobenzenesulfonamide, N-bromo-N-methylbenzene-sulfonamide, 1,3-dibromo-4,4-dimethylhydantoin, potassium salt of dibromoisocyanuric acid and trichloroisocyanuric acid.

Detailed mechanism of how the image-forming member is given the image-forming capability when it is subjected to the pre-treatment by heating, or how such image-forming capability is increased, has yet to be clarified, though it may be assumed as follows.

That is, by carrying out the pre-treatment by heating, the image-forming capability is increased in the image-forming member having the image-forming capability, in which silver halide is added from the beginning, or such silver halide has been produced, while an effective image-forming capability is imparted to the image-forming member, in which no silver halide is present, or no halide capable of producing silver halide is present. Since the common point in the above-mentioned both types of the image-forming member resides in the existence of organic silver salt, the organic silver salt which does not almost bring about the dissociation reaction at a normal temperature (or room temperature) gives rise, in part, to such dissociation reaction by the action of heat in the pre-treatment to produce silver ion. This silver ion is then subjected to the action of the reducing agent to produce a neutral body of silver which constitutes a photosensitive nucleus in the exposure step. The production of the silver body from this organic silver salt is assumed to impart the image-forming capability to the image-forming member which has no capability at all, or almost no such capability, or to increase the image-forming capability in the image-forming member.

For the electrically insulating medium to form the organic silver salt layer, the following are enumerated.

For example, polyvinyl butyral, polyvinyl acetate cellulose diacetate, cellulose triacetate, cellulose acetate butyrate, polyvinyl alcohol, ethyl cellulose, methyl cellulose, benzyl cellulose, polyvinyl acetal, cellulose propionate, cellulose acetate propionate, hydroxyethyl cellulose, ethylhydroxy cellulose, carboxymethyl cellulose, polyvinyl formal, polyvinylmethylether, styrene-butadiene copolymer and polymethyl methacrylate. If necessary, two or more of these compounds may be mixed for use. The content of the electrically insulating medium may be usually 0.02 – 20 parts by weight particularly 0.1 – 5 parts by weight per 1 part by weight of the organic silver salt. Further, it necessary, a plasticizer may be added to form an image-forming material. As the plasticizer, there may be mentioned, for example, dioctyl phthalate, tricresyl phosphate, diphenyl chloride, methylnaphalene, p-terphenyl and diphenyl.

As the solvents for dispersing the organic silver salt in the electrically insulating medium, there may be mentioned methylene chloride, chloroform, dichloroethane, 1,1,2-trichloroethane, trichloroethylene, tetrachloroethane, carbon tetrachloride, 1,2-dichloropropane, 1,1,1-trichloroethane, tetrachloroethylene, ethyl acetate, butyl acetate, isoamyl acetate, cellosolve acetate, toluene, xylene, acetone, methyl ethyl ketone, dioxane, tetrahydrofuran, dimethylamide, N-methylpyrrolidone, alcohols such as methyl alcohol, ethyl alcohol, isopropyl alcohol, butyl alcohol and the like, and water.

The base may be a metal plate such as aluminum, copper, zinc, silver and the like, a metal laminate paper, a paper treated to prevent permeation of a solvent, a paper treated with a conductive polymer, a synthetic resin film containing a surface active agent; and a glass, a paper, a synthetic resin sheet and a film such as cellulose acetate film, polycarbonate film, polystyrene film and the like which have on the surface a vapor-deposited metal, metal oxide or metal halide. In particular, a flexible metal sheet, paper or other conductive materials which can be wound on a drum are preferable.

Preparation of the image-forming member, can be done generally by forming the layers of organic silver salt and reducing agent on a substrate. The film forming or coating method may be relied on those well known to form a thin film from a synthetic resin. For example, emulsion of these materials is coated on the substrate in an adjustable thickness ranging from a few microns to a few tens of microns depending on the purpose by means of rolling method, wire-bar method, pouring and spreading method, and air knife method, etc.

The basic steps to form the electrostatic printing master by the use of the image-forming member, which has so far been explained, consist of the pre-treatment by heating, image exposure, and development by heating. By the pre-treatment under heat, the image-forming member is given its image-forming capability, or increases its capability. By the subsequent image exposure step, a latent image is formed in the organic silver salt layer. Finally, by the heat development, the latent image is rendered visible (i.e., a silver image is formed).

Thus, for the image-forming member, in which the silver image has been formed, to be used as the electrostatic printing master, it is preferable that electrical resistance (resistivity) of the non-silver image portion to be created in the organic silver salt layer be made greater by two places or more, more particularly three places or more, than the silver image portion. Incidentally, it is preferable that resistivity of the non-silver image portion be established at $10^{10}$ ohm-cm or more, more particularly at $10^{11}$ ohm-cm or more, and optimumly at $10^{13}$ ohm-cm or more, and that resistivity of the silver image portion be established at $10^{13}$ ohm-cm or less, and more particularly at $10^{10}$ ohm-cm.

As mentioned in the foregoing, the image-forming member is formed by providing the organic silver salt layer, etc. on the substrate. In laminating these layers, the entire thickness of the lamination should preferably be from 1 to 50 microns, or more particularly from 2 to 30 microns.

Mode of carrying out the printing process by the use of the electrostatic printing master prepared in the above-described manner is illustrated in general in FIGS. 2 to 5. In these drawings, explanations are made with reference to the electrostatic printing master obtained from the image-forming member shown in FIG. 1.

Figure 2:
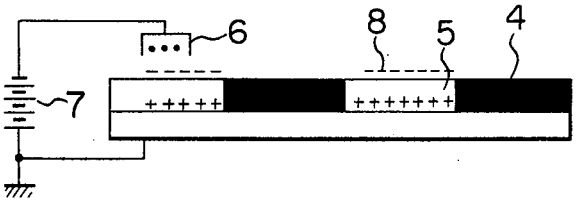
FIG. 2 – FIG. 5 show an embodiment of the latter half of a series of the electrostatic printing steps according to the present invention, in which FIG. 2, FIG. 3, FIG. 4 and FIG. 5 respectively show a charging step, a developing step, a transferring step, and a cleaning step.
Figure 3:
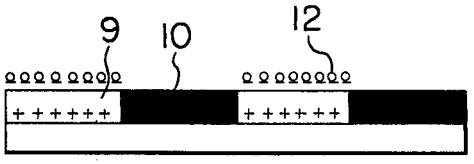
Figure 4:
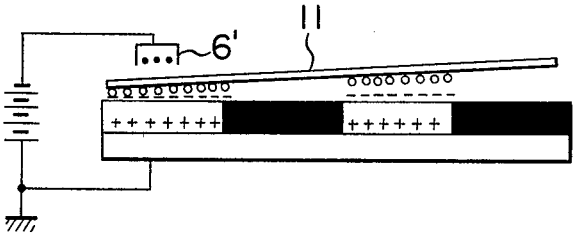
Figure 5:
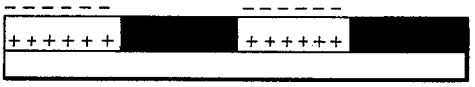

As shown in FIG. 2, a master bearing a silver image 4 is caused to pass under, for example, a negative corona electrode 6 so that negative charges 8 can be formed on the surface region having no silver image 5, that is, non-silver image portion of the master. In this case, either a positive corona electrode or an alternating current corona electrode may be used in place of the negative corona electrode, and a contact electrode may be utilized in place of the corona electrode. As the result of the above-mentioned charging, a latent image of the electrostatic charges is selectively formed on the region having no silver image in the master. Such latent image of the electrostatic charges is subjected to a toner treatment in a usual manner, for example, cascade, magnetic brush, liquid, Magne-dry and wetting developments as shown in FIG. 3. If the toner particles 12 are electrically conductive and charges are not particularly imparted thereto, or if they have charges opposite to those of the image of the electrostatic charges, they adhere to a portion 9 to which charges are imparted. On the other hand, if the same charges as those of the image are imparted to the toner particles, the particles adhere to a portion 10 to which charges are not imparted. As shown in FIG. 4, an image-receiving material 11 is brought into contact with the surface of the toner image and the toner image can be transferred to image-receiving material 11 by using, for example, a corona electrode 6' of the opposite polarity to that of the toner from the back side of the image-receiving material 11. The toner image thus transferred can be fixed by technique conventionally known in the art. Usually, heating fixation, solvent fixation and the like are employed. In case liquid development is carried out, it is sufficient to heat merely the toner image. Besides, pressure-fixation method may be adopted. Subsequently, if necessary, the surface of the master may be cleaned by using a cleaning means such as a brush, a fur brush, cloth, a blade and the like to remove the remaining toner image as shown in FIG. 5.

The printing process is carried out either by the above-mentioned charging-developing-transferring-cleaning process or by recycle of the developing-transferring-cleaning process in which the durability of the electrostatic latent image is utilized. In this case, the cleaning step may be omitted, if desired. In a particular case, it is possible that an image having a sufficiently large amount of the toner is formed on the master in the first process to repeat the transferring of the toner image onto a different image-receiving material several times or more.

The polarity of the corona discharging may be either positive or negative direct current corona, and an alternating current corona may be used, and alternatively an electrode may be directly brought into contact with the master to impart electrostatic charges to the master. The electric potential due to the electrostatic charges is determined so as not to give rise to dielectric breakdown of the master, or spark.

In the preparation of the electrostatic printing master for use in the present invention, the substrate may be dispensed with. In utilizing this printing master for the electrostatic printing process, it may be set on an electrically conductive placing table. It may also be possible to adopt simultaneous charging on both surfaces of the master (e.g., corona discharge of mutually opposite polarity is applied to both surfaces of the printing master) for the electrical charging.

For the printing process, any other appropriate printing processes than that explained in reference to FIGS. 2 to 5 may be adopted. In this case, the substrate for constructing the image-forming member may be electrically insulative, or may be provided on its either surface with such insulating layer.

Figure 6:
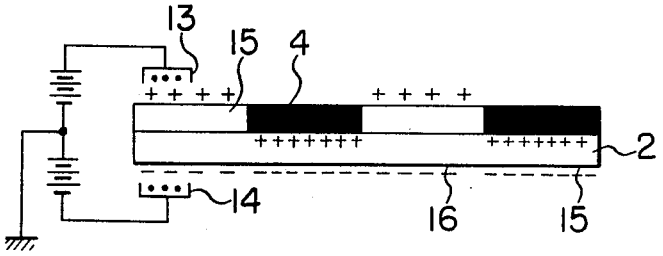
FIG. 6 – FIG. 8 diagrammatically show each embodiment of electrostatic printing process using an electrostatic printing master according to the present invention.

FIG. 6 illustrates an embodiment in which the base of an electrostatic printing master is of insulating property and the electrostatic printing master is subjected to double corona charging by corona electrodes 13 and 14, the polarities of which are selected to be opposite each other. Owing to the charging, in the non-silver image portion 5, electrostatic charges are imparted to both sides of the electrostatic printing master, in which case the polarity of the charges on one side of the master is opposite to that of the charges on the other side. On the other hand, in the silver image portion 4, the electrostatic charges imparted by the corona electrode 13 reach the interface between the silver image portion 4 and the base through the silver image portion 4 and charged there, since the silver image is electrostatically conductive. As the result, the silver image portion retains a large amount of the electrostatic charges through the base as compared with the non-silver image portion depending upon the difference in the electrostatic capacity between the silver image portion and the non-silver image portion which results from the difference in the interval for retaining charges between both portions. Consequently, the electrostatic charges are retained on the base surface 15 corresponding to the silver image portion in a higher charge density while they are retained on the base surface 16 corresponding to the non-silver image portion in a lower charge density so that an electrostatic image is formed. On the other hand, in the upper surface of the electrostatic printing master, the electrostatic charges are retained only on the non-silver image portion 5, thereby forming an electrostatic image. The latter electrostatic image and that formed on the base surface are in the relation ship of positive-negative with respect to the electrostatic contrast. The electrostatic image formed on the upper surface of the electrostatic printing master is developed with the toner having the opposite polarity to that of the electrostatic image to give a positive visible image, whereas it is developed with the toner having the same polarity as that of the electrostatic image to give a negative visible image although the contrast is deteriorated. On the other hand, the electrostatic image formed on the surface of the base is developed with the toner having the opposite polarity to that of the electrostatic image to give a negative visible image, whereas it is developed with the toner having the same polarity as that of the electrostatic image to give a positive visible image although the contrast is decreased. In case of the development with the toner having the same polarity as that of the electrostatic image, the electric potential of the toner is so determined that the electrostatic image to be developed may be sufficiently visualized. Needless to say, as the charging means, those other than the corona electrode may be optionally used as mentioned above.

Figure 7:
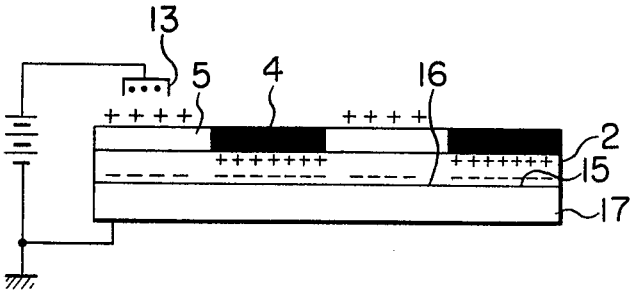

FIG. 7 illustrates one of the examples of other charging means, in which a charging electrode 17 is provided on the surface of the base in place of the corona electrode 14. The charging electrode 17 may be previously formed integrally with the electrostatic printing master, or it may formed in another way. Further, it may be in the form of a drum. The charging electrode may be removed after the charging operation.

Figure 8:
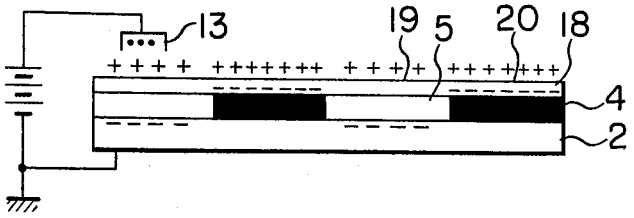

FIG. 8 illustrates the other embodiment of the printing process of the present invention using an electrostatic printing master having an electrically conductive base 2 and being provided with an insulating layer 18. The electrostatic printing master is charged by means of the corona electrode 13. As the result, the electrostatic charges on the non-silver image portion 5 (unexposed portion) are retained on both the portion 19 of the insulating layer 18 and the interface between the non-silver image portion 5 and the base 2, whereas the electrostatic charges on the silver image portion 4 (exposed portion) are retained on both the portion 20 of the insulating layer 18 and the interface between the insulating layer 18 and the silver image portion 4. The non-silver image portion 5 is small in its electrostatic capacity due to it being too distant to retain the electrostatic charges, hence the charge density at the non-silver image portion 5 is small. On the other hand, the charge density of the silver image portion 4 is large because its electrostatic capacity is large due to it being is sufficiently short distance to retain the electrostatic charges. As the result, an electrostatic image having a contrast, in which a small amount of the electrostatic charges is retained on the non-silver image portion 5, and in which a large amount thereof is retained on the silver image portion 4, is formed on the surface of the insulating layer 18. The thus formed electrostatic image is developed with the toner having the opposite polarity to that of the electrostatic charges of the image to give a negative visible image, while it is developed with the toner having the same polarity as that of the electrostatic image to give a positive visible image. In case of the development with the toner having the same polarity as that of the image, the electric potential of the toner is so determined that it may selectively adhere to the non-silver image portion. Needless to say, in the embodiment of FIG. 8, other charging means may be optionally adopted as in the case of FIG. 6. The insulating layer may be previously formed integrally with the electrostatic printing master, or it may be formed in other optional manners. This embodiment is useful and effective in that the insulating layer can function also as a protection layer.

In the embodiments illustrated in FIGS. 6 – 8, the developed visible image, i.e. the toner image, is transferred onto the transfer material. If necessary, the electrostatic printing master is then subjected to cleaning treatment, and subsequently, the charging-developing-transferring steps are repeated. When the difference in the electrostatic capacity between the non-silver image portion and the silver image portion is utilized to form an electrostatic image as in the embodiments shown in FIGS. 6 – 8, thickness of the insulating layer and the silver image-bearing layer is determined in such a manner that the contrast of the electrostatic image may be higher than a practical level.

As described above, the electrostatic printing process according to the present invention comprises at least a developing step and a transferring step, the developing step comprising developing an electrostatic latent image on the surface of a master for electrostatic printing which consists of a layer composed of a silver image portion containing metallic silver grains and a non-silver image portion having an electric resistance sufficient to retain electrostatic charges.

Other excellent advantages of the main function and the structure of the electrostatic printing master according to the present invention are pointed out as follows:

The master is extremely stable both chemically and physically since the image on the master is composed of silver, so that it is particularly superior in preservation for a long period of time, and it is also superior in the light-resistance, heat-resistance, wet-resistance and the like. Since the master bears the so-called "usual silver salt photographic image" on itself, the information to be printed can be easily verified directly from the master, and the master itself can be utilized as a record information.

The electrostatic printing master of the present invention has characteristically wide uses and meets with various purposes.

For the apparatus to carry out the electrostatic printing process according to the present invention, there may be contemplated such one that is capable of carrying out, in a single unit, the electrostatic printing master preparation treatment process (A) comprising pretreatment step by heating to the afore-described image-forming member, irradiating step to irradiate active radiation ray onto the image forming member, and development step by heating; and the printing process (B) comprising steps of applying charging treatment to the printing master, developing an electrostatic latent image, and transferring the developed image to an image receiving member; or such one that is capable of conducting the total process steps of the electrostatic printing process by combining an apparatus for carrying out the electrostatic printing master preparation treatment process (A) and an apparatus for carrying out the electrostatic printing process (B), and so forth.

The present invention will be understood more readily by reference to the following examples. However, these examples are intended to illustrate the invention and are not to be construed to limit the scope of the invention.

EXAMPLE 1

25 g of 50 mol %, silver behenate (*), 120 g of toluene, and 120 g of methyl ethyl ketone were mixed and dispersed in a ball mill for more than 72 hours. Thereafter, 100 g of polyvinyl butyral (10 wt. % ethyl alcohol solution) was added to the mixture and sufficiently agitated to prepare a polymer dispersion liquid of silver behenate. To the thus prepared polymer dispersion liquid, there was further added 200 mg of mercury acetate to make the liquid mixture an organic silver salt layer forming solution. This liquid was subsequently applied on art paper by the use of a coating rod (No. 30), and dried at 60° C, thereby forming an organic silver salt layer.

(*) "50 mol % silver behenate" as used throughout the examples, is meant by a case wherein the silver salt of organic acid obtained from the following mathematics stands for silver behenate. That is, a mol number of silver salt of an organic acid is divided by a sum of a mol number of the organic acid and a mol number of the silver salt of the organic acid, and a divided is multiplied by 100. The "mol %" of silver salt of organic acid appearing hereinafter is understood to have the abovementioned meaning.

On the other hand, 1.7 g of 2,2'-methylene-bis-(6-t-butyl-p-cresol), 10 g of cellulose acetate (10 wt. % acetone solution), 30 mg of potassium bromide, and 0.8 g of phthalazinone were mixed to prepare an overlayer solution.

The thus prepared overlayer solution was applied over the abovementioned organic silver salt layer by means of a coating rod (No. 24), and dried at 60° C and below, thereby making it the image-forming member for producing the electrostatic printing master.

Next, the image-forming member was subjected to a pretreatment by heating at 110° C for 2 seconds, after which exposure of a positive image was conducted thereon for 15 seconds by the use of a tungsten lamp (5,000 lux). Subsequent to the image exposure, development was conducted under heat of 130° C for 4 seconds, thereby obtaining a visible negative image for print.

Thereafter, a corona discharge of +7KV was uniformly applied to this developed image-forming member, and then the corona-discharged image-forming member was subjected to development with a negatively charged toner by means of the magnet brush developing method, whereupon a positive toner image was obtained. On this positive toner image, there was overlaid an image transfer paper, and the above-mentioned corona discharge was imparted from the side of the image transfer paper. A very clear image free from fogging could be obtained on the image transfer paper.

The electric charging, developing and image transferring were repeated to conduct the printing process. As the result, no deterioration could be observed on the surface of the printing master even after 1,000 times of the image transfer operation, hence no deterioration in the image transferred on the transfer paper. Thus, superiority of the printing master for the repeated electrostatic printing could be recognized.

Since the silver image exhibits faithful reproducibility to the original image, an electrostatic charge corresponding to the original image, hence the toner image, could accordingly represent the faithful photographic image.

Then, when the electrostatic characteristic of the abovementioned printing master was measured, the electrostatic contrast, i.e., potential difference in the electric charge between the image portion (silver image portion) and the non-image portion (non-silver image portion) was found to be 300 V, which was a favorable result.

EXAMPLE 2

In the same manner as mentioned in the preceding Example 1, the following organic silver salt layer forming composition A-1 and the overlayer forming composition B-1 were prepared.

| Composition A-1 | |
|---|---|
| 90 mol % silver behenate | 15 g |
| Behenic acid | 15 g |
| Toluene | 120 g |
| Methyl ethyl ketone | 120 g |
| Polyvinyl butyral (10 wt.% ethyl alcohol solution) | 100 g |

| Composition B-1 | | |
|---|---|---|
| 2,2'-methylene-bis-(6-t-butyl-p-cresol) | 1.6 | g |
| Rubidium bromide | 40 | mg |
| Phthalazinone | 0.8 | g |
| Cellulose acetate (10 wt.% acetone solution) | 10 | g |
| Acetone | 30 | g |
| 3,3'-diethyl-2,2'-thiacarbocyanine iodide | 8 | mg |

The abovementioned compositions were applied onto art paper to obtain the image-forming member for preparing the electrostatic printing master.

Then, this image-forming member was subjected to pre-treatment by heating at 110° C for 2 seconds, after which exposure of a positive image was conducted thereon for 8 seconds by the use of a tungsten lamp (5,000 lux). Subsequent to the image exposure, development was conducted under heat of 130° C for 4 seconds whereby a visible negative image for print was obtained.

Thereafter, the same measurement as in Example 1 above was conducted to find out whether this electrostatic printing master possesses the characteristics suited for the purpose. A favorable result could be obtained, from which it was recognized that the printing master prepared from the image-forming member possessed excellent capability as the electrostatic printing master.

EXAMPLE 3

The following tests were conducted on the image-forming members in both Examples 1 and 2 above.

Following the same procedures as in Examples 1 and 2 above, an image was formed on the image-forming members A and B, respectively, whereby the electrostatic printing master A' and B' were obtained. These printing masters were suspended for 2 minutes in a vessel filled with vapor of tri-chloro-ethylene, and then these sample masters were subjected to re-heating under the same developing conditions as in the respective Examples. No ground fogging could be observed. Further, as is the case with Example 1, the characteristics of these sample masters were measured with fovorable results.

When these masters were used in the electrostatic printing after they were suspended in the vapor of tri-chloroethylene, they became durable for storage over a very long time period.

EXAMPLE 4

In the same manner as mentioned in the preceding Example 1, the following organic silver salt layer forming composition A-2 and the overlayer forming composition B-2 were prepared.

| Composition A-2 | |
|---|---|
| 30 mol% silver behenate | 25 g |
| Toluene | 120 g |
| Methyl ethyl ketone | 120 g |
| Polyvinyl butyral (10 wt.% ethyl alcohol solution) | 100 g |
| Tetrabromo-butane | 300 mg |
| Phthalazinone | 3.0 g |
| Mercury acetate | 120 mg |
| 3,3'-diethyl-2,2'-thiacarbocyanine iodide | 50 mg |

| Composition B-2 | |
|---|---|
| 2,4,4'-trimethylpentyl-(2-hydroxy-3,5-dimethyl-phenyl) methane | 1.5 g |

The abovementioned compositions were applied onto art paper to obtain the image-forming member for preparing the electrostatic printing master.

From this image-forming member, the electrostatic printing master was obtained by forming a silver image therein in accordance with the same procedures as in Example 2 above, and then the characteristics thereof were measured also in the same manner as in Example 2. It was recognized that this printing master possessed excellent performance as the electrostatic printing master.

EXAMPLE 5

A composition of A-3 of the under-mentioned recipe was applied on art paper as an under-coat by the use of a coating rod (No. 30), and dried under heat of 70° C.

Subsequently, another composition B-3 of the under mentioned recipe was applied over this under-coat by means of a coating rod (No. 40), and dried under heat of 70° C to form an over-coat. Thus, the image-forming member for the electrostatic printing master was obtained.

| Composition A-3 | |
|---|---|
| N-bromo-Phthalzinone | 1.5 g |
| Polyvinyl butyral (10 wt.% ethyl alcohol solution) | 10 g |
| Dibromo-butane | 30 g |

| Composition B-3 | |
|---|---|
| 20 mol% silver behenate | 25 g |
| Toluene | 120 g |
| Methyl ethyl ketone | 120 g |
| Cellulose acetate (10 wt.% acetone solution) | 100 g |
| N-bromo-phthalazinone | 2.5 g |
| Mercury acetate | 120 mg |
| 2,4,4'-trimethylpentyl-2-hydroxy-3,5-dimethyl-phenyl)methane | 1.5 g |
| 3,3'-diethyl-2,2'-thiacarbocyanine iodide | 50 mg |

From this image-forming member, the electrostatic printing master was obtained by forming a silver image therein in accordance with the same procedures as in Example 2 above, and then the characteristics thereof were measured also in the same manner as in Example 2. It was recognized that this printing master possessed excellent performance as the electrostatic printing master.

EXAMPLE 6

In the same manner as mentioned in the preceding Example 1, the following organic silver salt layer forming composition A-4 and the overlayer forming composition B-4 were prepared.

| Composition A-4 | |
|---|---|
| 90 mol% silver behenate | 5 g |
| 20 mol% silver behenate | 20 g |
| Toluene | 120 g |
| Methyl ethyl ketone | 120 g |
| Polyvinyl butyral (10 wt.% ethyl alcohol solution) | 100 g |
| Phthalazinone | 2.0 g |

| Composition B-4 | |
|---|---|
| 2,2'-methylene-bis-(6-t-butyl-p-cresol) | 1.7 g |
| Mercury acetate | 30 mg |
| Ammonium bromide | 50 mg |
| Phthalazinone | 0.8 g |
| Cellulose acetate (10 wt.% acetone solution) | 10 g |
| Acetone | 30 g |
| 3,3'-diethyl2,2'-thiacarbocyanine iodide | 8 mg |

The abovementioned compositions were applied onto art paper to obtain the image-forming member for preparing the electrostatic printing master.

From this image-forming member, the electrostatic printing master was obtained by forming a silver image therein in accordance with the same procedures as in Example 2 above, and then the characteristics thereof were measured also in the same manner as in Example 2. It was recognized that this printing master possessed excellent performance as the electrostatic printing master.

EXAMPLE 7

In the same manner as mentioned in the preceding Example 1, the following organic silver salt layer forming composition A-5 and the overlayer forming composition B-5 were prepared.

| Composition A-5 | |
|---|---|
| 60 mol% silver stearate | 20 g |
| Stearic acid | 8 g |
| Toluene | 120 g |
| Methyl ethyl ketone | 120 g |
| Polyvinyl butyral (10 wt.% ethyl alcohol solution) | 100 g |
| Phthalazinone | 2.0 g |

| Composition B-5 | |
|---|---|
| 2,2'-methylene-bis-(6-t-butyl-p-cresol) | 1.2 g |
| Mercury acetate | 20 mg |
| Ammonium bromide | 50 mg |
| Phthalzinone | 0.8 g |
| Cellulose acetate | 10 g |

-continued

| Composition B-5 | |
|---|---|
| (10 wt.% acetone solution) | |
| Acetone | 30 g |
| 3,3'-diethyl-2,2'-thiacarbocyanine iodide | 8 mg |

The abovementioned compositions were applied onto art paper to obtain the image-forming member for preparing the electrostatic printing master.

Then, this image-forming member was subjected to pretreatment by heating at 110° C for 2 seconds, after which exposure of a positive image was conducted thereon for 8 seconds by the use of a tungsten lamp (5,000 lux). Subsequent to the image exposure, development was conducted under heat of 130° C for 2 seconds, whereby the printing master having a visible negative image was obtained.

Thereafter, in accordance with the method in Example 1, measurement was conducted to find out whether this electrostatic printing master possessed the characteristics suitable for the purpose. A favorable result could be obtained.

EXAMPLE 8

In the same manner as mentioned in the preceding Example 1, the following organic silver salt layer forming composition A-6 and the overlayer forming composition B-6 were prepared.

| Composition A-6 | |
|---|---|
| 30 mol% silver laurate | 25 g |
| Toluene | 120 g |
| Methyl ethyl ketone | 120 g |
| Polyvinyl butyral (10 wt.% ethyl Alcohol solution) | 100 g |
| Phthalazinone | 2.0 g |

| Composition B-6 | |
|---|---|
| 2,2'-methylene-bis-(6-t-butyl-p-cresol) | 0.8 g |
| Mercury acetate | 20 mg |
| Phthalazinone | 0.8 g |
| Cellulose acetate (10 wt.% acetone solution) | 10 g |
| Acetone | 20 g |
| 3,3'-diethyl-2,2'-thiacarbocyanine iodide | 8 mg |

The abovementioned compositions were applied onto art paper to obtain the image-forming member for preparing the electrostatic printing master.

From this image-forming member, the electrostatic printing master was obtained by forming a silver image therein in accordance with the same procedures as in Example 2 above, and then the characteristics thereof were measured also in the same manner as in Example 2. It was recognized that this printing master possessed excellent performance as the electrostatic printing master.

EXAMPLE 9

25 g of 25 mol% silver behenate, 120 g of toluene, and 120 g of methyl ethyl ketone were mixed and dispersed in a ball mill for more than 72 hours. Thereafter, 100 g of polyvinyl butyral (10 wt.% ethyl alcohol solution) was added to the mixture and sufficiently agitated to prepare a polymer dispersion liquid of silver behenate.

To the thus prepared polymer dispersion liquid, there was added 50 mg of 3,3'-diethyl-2,2'-thiacarbocyanine iodide, and sufficiently mixed.

This polymer dispersion liquid was then applied onto art paper by the use of a coating rod (No. 40), and dried at approximately 70° C and below.

Subsequently, cellulose acetate butyrate (5 wt.% methyl ethyl ketone solution) was applied as the second layer over the abovementioned layer by means of a coating rod No. 10), and dried.

Further, as the third layer, a composition C of the following recipe was prepared, applied over the second layer by means of a coating rod (No. 30), and dried, whereby the image-forming member for the electrostatic printing master was obtained.

| Composition C | | |
|---|---|---|
| 1,1-bis(2-hydroxy-3,5-dimethylphenyl-3,5,5-trimethylhexane | 0.8 | g |
| Cellulose acetate (10 wt.% acetone solution) | 10 | g |
| calcium bromide | 70 | mg |
| Phthalzinone | 0.5 | g |
| 3,3'-diethyl-2,2'-thiacarbocyanine iodide | 8 | mg |

From this image-forming member, the electrostatic printing master was obtained by forming a silver image therein in accordance with the same procedures as in Example 2 above, and then the characteristics thereof were measured also in the same manner as in Example 2. It was recognized that this printing master possessed excellent performance suitable for the electrostatic printing process.

EXAMPLE 10

In the same manner as mentioned in the foregoing Example 1, the following organic silver salt layer forming composition A-7 and the overlayer forming composition B-7 were prepared.

| Composition A-7 | | |
|---|---|---|
| 35 mol% silver behenate | 25 | g |
| Toluene | 120 | g |
| Methyl ethyl ketone | 120 | g |
| Polyvinyl butyral (10 wt.% ethyl alcohol solution) | 100 | g |
| Phthalazinone | 2.0 | g |
| **Composition B-7** | | |
| 2,2'-methylene-bis-(6-t-butyl-p-cresol) | 1.7 | g |
| Phthalazinone | 0.8 | g |
| Cellulose acetate (10 wt.% acetone solution) | 10 | g |
| Acetone | 30 | g |
| 3,3'-diethyl-2,2'-thiacarbocyanine iodide | 8 | mg |

The abovementioned compositions were applied onto art paper to obtain the image-forming member for preparing the electrostatic printing master.

From this image-forming member, the electrostatic printing master was obtained by forming a silver image therein in accordance with the same procedures as in Example 2 above, and then the characteristics thereof were measured also in the same manner as in Example 2. It was recognized that this printing master possessed excellent performance suitable for the electrostatic printing process. The time for the pre-treatment by heating was 5 seconds.

EXAMPLE 11

20 g of 70 mol% silver behenate, 10 g of 90 mol% copper stearate, 120 g of methyl ethyl ketone, and 120 g of toluene were mixed and dispersed in a ball mill for more than 72 hours. Thereafter, 100 g of polyvinyl butyral (20 wt.% ethyl alcohol solution) and 50 g of ethanol were added to the mixture and sufficiently agitated to prepare a polymer dispersion liquid of organic silver salt.

Then, this polymer dispersion liquid was applied onto art paper by means of a coating rod (No. 40), and dried at 70° C and below.

On the other hand, a separate mixture was prepared by mixing and dispersing 1.5 g of 2,6-di-t-butyl-p-cresol, 0.3 g of phthalazinone, 10 g of polyvinylbutyral (10 wt.% ethyl alcohol solution), and 30 g of acetone. This mixture was applied over the abovementioned coated layer by means of a coating rod (No. 24), and dried at 70° C and below, whereby the image-forming member for the electrostatic printing master was obtained.

Then, this image-forming member was subjected to pretreatment by heating at 115° C for 2 seconds, after which exposure of a positive image was conducted thereon for 15 seconds by the use of a tungsten lamp (5,000 lux). Subsequent to the image exposure, development was conducted under heat of 135° C for 4 seconds, whereupon the printing master having a favorable visible image was obtained.

Thereafter, the same measurement as in Example 2 above was conducted to find out whether this electrostatic printing master possessed the excellent characteristics as the electrostatic printing master. It was recognized that the master had such performance suited for the purpose.

EXAMPLE 12

In the same manner as mentioned in the foregoing Example 1, the following organic silver salt layer forming composition A-8 and the overlayer forming composition B-8 were prepared.

| Composition A-8 | | |
|---|---|---|
| 90 mol% silver behenate | 25 | g |
| Toluene | 120 | g |
| Methyl ethyl ketone | 120 | g |
| Polyvinylbutyral (10 wt.% ethyl alcohol solution) | 100 | g |

| Composition B-8 | | |
|---|---|---|
| 2,2'-methylene-bis-(6-t-butyl-p-cresol) | 1.8 | g |
| Phthalazinone | 0.8 | g |
| Cellulose acetate (10 wt.% acetone solution) | 10 | g |
| Acetone | 30 | g |
| 3,3'-diethyl-2,2'-thiacarbocyanine iodide | 8 | mg |

The abovementioned compositions were applied onto art paper to obtain the image-forming member for preparing the electrostatic printing master.

Then, this image-forming member was subjected to pre-treatment by heating member was subjected to pre-treatment by heating at 110° C for 5 seconds, after which exposure of a positive image was conducted thereon for 8 seconds by the use of a tungsten lamp (5,000 lux). Subsequent to the image exposure, development was conducted under heat of 130° C for 3 seconds, whereby the printing master having a visible negative image for printing was obtained.

Thereafter, the same measurement as in Example 1 above was conducted to find out whether this electrostatic printing master possessed the characteristic as the electrostatic printing master. A favorable result could be obtained, from which it was recognized that the printing master obtained from the image-forming member of the abovementioned type possessed the excellent performance as the electrostatic printing master.

EXAMPLE 13

In the same manner as mentioned in the foregoing Example 1, the following organic silver salt layer forming composition A-9 and the overlayer forming composition B-9 were prepared.

| Composition A-9 | | |
|---|---|---|
| 90 mol% silver stearate | 25 | g |
| Toluene | 120 | g |
| Methyl ethyl ketone | 120 | g |
| Polyvinyl butyral (10 wt.% ethyl alcohol solution) | 100 | g |
| Phthalazinone | 2.0 | g |

| Composition B-9 | | |
|---|---|---|
| 2,2'-methylene-bis-(6-t-butyl-p-cresol) | 1.2 | g |
| Phthalazinone | 0.8 | g |
| Cellulose acetate (10 wt.% acetone solution) | 10 | g |
| Acetone | 30 | g |
| 3,3'-diethyl-2,2'-thiacarbocyanine oidide | 8 | mg |

The abovementioned compositions were applied onto art paper to obtain the image-forming member for preparing the electrostatic printing master.

From this image-forming member, the electrostatic printing master was obtained by forming silver image therein in accordance with the same procedures as in Example 2 above, and then the characteristics thereof were measured also in the same manner as in Example 2. It was recognized that this printing master possessed excellent performance as the electrostatic printing master.

EXAMPLE 14

The exactly same procedures as in Example 8 above were followed to prepare the electrostatic printing master, with the exception that 80 mol% silver laurate was used in place of 30 mol% silver laurate in Example 8 in the same amount. The thus prepared printing master exhibited favorable performance. No mercury acetate was added in this example.

EXAMPLE 15

In the same manner as mentioned in the foregoing Example 1, the following organic silver salt layer forming composition A-10 and the overlayer forming composition B-10 were prepared.

| Composition A-10 | | |
|---|---|---|
| 40 mol% silver behenate | 25 | g |
| Toluene | 120 | g |
| Methyl ethyl ketone | 120 | g |
| Polyvinyl butyral (10 wt.% ethyl alcohol solution) | 100 | g |

-continued

| Composition A-10 | | |
|---|---|---|
| N,N-dibromobenzenesulfonamide | 200 | mg |

| Composition B-10 | | |
|---|---|---|
| Cellulose acetate (10 wt.% acetone solution) | 10 | g |
| Acetone | 30 | g |
| 2,2'-methylene-bis-(6-t-butyl-p-cresol) | 2.0 | g |
| Phthalazinone | 0.3 | g |
| 3,3'-diethyl-2,2'-thiacarbocyanine iodide | 8 | mg |

The abovementioned compositions were applied onto art paper to obtain the image-forming member for preparing the electrostatic printing master.

From this image-forming member, the electrostatic printing master was obtained by forming a silver image therein in accordance with the same procedures as in Example 2 above, and then the characteristics thereof were measured also in the same manner as in Example 2. It was recognized that this printing master possessed excellent performance as the electrostatic printing master.

EXAMPLE 16

A visible negative image for printing was formed on the image-forming member for preparing electrostatic printing master as obtained in exactly the same manner as in Example 1 above, thereby obtaining the electrostatic printing master.

Then, this printing master was subjected to electric charging by imparting thereto a uniform corona discharge of +7KV. For an image receiving member, "Mylar" sheet, on one surface of which aluminium is vapor-deposited, was used. ("Mylar" is a trademark for polyester film produced and sold by E. I. du Pont de Nemours & Co., U.S.A.) The non-deposited surface of the Mylar film was made close to the charged surface of the printing master, i.e., to the surface where an electrostatic latent image is formed, and then an electrically conductive rubber roll was caused to contact the aluminum-deposited surface of the Mylar film to exfoliate the aluminum-deposited Mylar film along the electrically conductive rubber roll. Thereafter, when the aluminum-deposited Mylar film bearing thereon the electrostatic latent image was developed with a negatively charged toner by means of the magnet brush development method, there was obtained a positive image of high image quality which is free from fogging, high density, and good reproducibility in gradation.

The charging, electrostatic transfer, and development were repeated over 1,000 time and more, but no deterioration whatsoever could be recognized on the surface of the printing master, hence the quality of the developed image was in no way impaired.

From the above, it was recognized that the printing master obtained from the image-forming member of Example 1 had a very excellent performance as the electrostatic printing master.

EXAMPLE 17

In place of the aluminum-deposited Mylar film in Example 16 above, an insulating paper was used as the image receiving member. On to the surface of this insulating paper opposite to that facing the printing master, there was contacted an opposite electrode, and the same operations as in Example 16 were conducted. The same favorable result as that in Example 16 was obtained.

EXAMPLE 18

The same measurements as in Examples 15 and 16 were conducted on each of the electrostatic printing masters obtained in Examples 2 to 15. All of them exhibited excellent performance as the electrostatic printing masters.

What we claim is:

1. In a process for electrostatic printing which includes (1) a step for forming an electrostatic latent image by subjecting a printing master to an electric charging treatment, (2) a step of developing the electrostatic latent image, and (3) a step of transferring the developed image onto an image-receiving material, the improvement which comprises: employing an electrostatic printing master formed by (A) subjecting an image-forming member to a preheat treatment to enhance image-forming capability, said member having a first layer, wherein an organic silver salt is dispersed in an electrically insulating medium and a reducing agent is associated with said first layer, (B) irradiating said image-forming member with an active radiation ray, and (C) heat-developing said image-forming member.

2. The process as set forth in claim 1, wherein at least said steps (2) and (3) are repeatedly carried out.

3. The process as set forth in claim 1, wherein said steps (A) and (B) are carried out sequentially.

4. The process as set forth in claim 1, wherein said steps (A) and (B) are carried out contemporaneously.

5. The process as set forth in claim 1, wherein the image-transfer in said step (3) is a charging transfer method.

6. The process as set forth in claim 1, wherein said image-forming member contains silver halide.

7. The process as set forth in claim 6, wherein said silver halide is contained in said first layer.

8. The process as set forth in claim 1, wherein said image-forming member further contains another halide compound to produce silver halide by reaction with said organic silver salt.

9. The process as set forth in claim 8, wherein said halide compound containing layer is isolated by a reaction preventive layer from said first layer so that said halide compound may not react with said organic silver salt in said first layer in an ordinary condition.

* * * * *